US008494403B2

(12) United States Patent
Park

(10) Patent No.: US 8,494,403 B2
(45) Date of Patent: Jul. 23, 2013

(54) DEVELOPING DEVICE AND IMAGE FORMING APPARATUS USING THE SAME

(75) Inventor: Jong Hyun Park, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 248 days.

(21) Appl. No.: 12/894,436

(22) Filed: Sep. 30, 2010

(65) Prior Publication Data

US 2011/0097103 A1 Apr. 28, 2011

(51) Int. Cl.
*G03G 21/00* (2006.01)

(52) U.S. Cl.
USPC ..... 399/99; 399/98; 399/222

(58) Field of Classification Search
USPC ..... 399/98, 99, 222
See application file for complete search history.

(56) References Cited

U.S. PATENT DOCUMENTS

| | | | | |
|---|---|---|---|---|
| 5,177,533 | A * | 1/1993 | Ishiguro et al. | 399/130 |
| 5,220,382 | A * | 6/1993 | Hediger | 399/256 |
| 5,387,963 | A * | 2/1995 | Kajimoto et al. | 399/98 |
| 5,483,322 | A * | 1/1996 | Otome et al. | 399/106 |
| 2005/0095028 | A1 * | 5/2005 | Lee et al. | 399/98 |
| 2007/0059025 | A1 * | 3/2007 | Lee | 399/98 |

* cited by examiner

*Primary Examiner* — Ryan Walsh
(74) *Attorney, Agent, or Firm* — Stanzione & Kim, LLP

(57) ABSTRACT

A developing device includes an image carrier on which an electrostatic latent image is formed, a developing member facing the image carrier to supply a developing agent to the electrostatic latent image formed on the image carrier, a rotary member facing the outer circumference of the image carrier in a non-contact state to collect toner scattered from the developing member, and a gear train to drive the rotary member. An effect that the developing member is subjected to by the driving of the rotary member is minimized, thereby preventing deterioration of image quality. Also, the scattering of the developing agent is effectively prevented by adjusting the drive rotational velocity of the rotary member.

13 Claims, 9 Drawing Sheets

DEVELOPING DEVICE AND IMAGE FORMING APPARATUS USING THE SAME

CROSS-REFERENCE TO RELATED APPLICATIONS

This application claims the benefit of priority under 35 U.S.C. §119 from Korean Patent Application No. 2009-0101268, filed on Oct. 23, 2009 in the Korean Intellectual Property Office, the disclosure of which is incorporated herein by reference in its entirety.

BACKGROUND

1. Field of the Invention

Embodiments of the present general inventive concept relate to a developing device and an electrophotographic image forming apparatus using the same.

2. Description of the Related Art

An electrophotographic image forming apparatus irradiates light modulated according to image information to a photosensitive body to form an electrostatic latent image at the surface of the photosensitive body, supplies toner to the electrostatic latent image to develop a visible toner image, and transfers and fuses the toner image to a print medium to print the image to the print medium.

An electrophotographic image forming apparatus includes a process cartridge to develop a visible toner image to a photosensitive body and a toner cartridge to contain a toner to be supplied to the process cartridge. The toner cartridge may be detachably mounted in the image forming apparatus. When toner in a toner cartridge is completely consumed, the toner cartridge is replaced with a new one.

SUMMARY

The present general inventive concept provides a developing device having an improved structure to drive a rotary member to collect a developing agent scattered from a developing member. The present general inventive concept also provides an image forming apparatus using an improved developing device to drive a rotary member to collect a developing agent scattered from a developing member.

Additional features of the present general inventive concept will be set forth in part in the description which follows and, in part, will be obvious from the description, or may be learned by practice of the invention.

In accordance with one embodiment of the present general inventive concept, a developing device of an image forming apparatus includes a developing member rotatably disposed and spaced apart from an image carrier to supply a developing agent to the image carrier, a developing agent containing part to contain the developing agent, a rotary member to generate air flow to collect a portion of the developing agent scattered in a developing region between the image carrier and the developing member into the developing agent containing part, a developing member gear provided at one side of the developing member to be rotated by external drive force, and a rotary member gear provided at one side of the rotary member, the rotary member gear being indirectly connected to the developing member gear such that drive force is transmitted to the rotary member gear.

The developing device may further include at least one developing agent feeding member rotatably disposed in the developing agent containing part to feed the developing agent to the developing member, drive force being transmitted from the developing agent feeding member to the rotary member.

The developing device may further include a feeding member gear disposed at one side of the developing agent feeding member to be rotated together with the developing agent feeding member and at least one idle gear arranged between the feeding member gear and the rotary member gear to transmit rotation force from the developing agent feeding member to the rotary member.

The developing device may further include a feeding member drive gear disposed at the other side of the developing agent feeding member and at least one gear arranged between the developing member gear and the feeding member drive gear to transmit rotation force from the developing member gear to the feeding member drive gear.

The developing device may further include a cleaning member to clean a surface of the rotary member.

The rotary member may be subjected to a collection bias to collect the portion of the developing agent scattered from the developing member.

The rotary member may have a drive rotational velocity of 50 revolutions per minute (RPM) to 150 RPM.

In accordance with another embodiment of the present general inventive concept, a developing device of an image forming apparatus to supply a developing agent to an image carrier to form a visible image on the image carrier includes a frame having a developing agent containing part defined therein, a developing member rotatably disposed in the frame to supply the developing agent to the image carrier, a developing agent feeding member rotatably disposed in the developing agent containing part to feed the developing agent from the developing agent containing part to the developing member, a rotary member rotatably disposed adjacent to the developing member to generate air flow to collect a portion of the developing agent scattered from the developing member into the frame, and a power transmission unit to transmit rotational force from the developing agent feeding member to the rotary member.

The developing device may further include a gear train to transmit rotational force from the developing member to the developing agent feeding member.

The power transmission unit may include a feeding member gear disposed at one side of the developing agent feeding member to be rotated together with the developing agent feeding member, a rotary member gear disposed at one side of the rotary member, and at least one idle gear disposed between the feeding member gear and the rotary member gear.

The gear train may include a feeding member drive gear disposed at a side of the developing agent feeding member opposite to the feeding member gear to transmit power to the developing agent feeding member, a developing member gear disposed at one side of the developing member, and at least one gear arranged to connect the developing member gear and the feeding member drive gear.

The power transmission unit may include at least one reduction gear.

The rotary member may be rotated in a direction opposite to a rotation direction of the developing member.

The portion of the developing agent collected by the rotary member may be forwarded to the developing agent containing part and supplied to the developing member.

Voltage may be applied to the rotary member such that the rotary member has lower potential than a surface of the image carrier.

The developing device may further include a cleaning member, having one end disposed in contact with a surface of the rotary member, to clean the rotary member.

In accordance with another embodiment of the present general inventive concept, an electrophotographic image forming apparatus includes a developing device to supply a developing agent to an image carrier to form a visible image on the image carrier having a frame having a developing agent containing part defined therein, a developing member rotatably disposed in the frame to supply the developing agent to the image carrier, a developing agent feeding member rotatably disposed in the developing agent containing part to feed the developing agent from the developing agent containing part to the developing member, a rotary member rotatably disposed adjacent to the developing member to generate air flow to collect a portion of the developing agent scattered from the developing member into the frame, and a power transmission unit to transmit rotational force from the developing agent feeding member to the rotary member; a transfer device to transfer a visible image formed on the image carrier to a print medium; and a fusing device to fuse the visible image to the print medium using heat and pressure.

The electrophotographic image forming apparatus may further include an apparatus body; a print media supply device to supply the print medium; a charging device to charge the image carrier to a predetermined potential; an optical scanning device to scan light corresponding to image information to the image carrier to form the visible image; and a print media discharging device to discharge the print medium out from the electrophotographic image forming apparatus. The image carrier may include a photoconductive drum.

In accordance with another embodiment of the present general inventive concept, a developing device usable with an image forming apparatus includes a frame having a developing agent containing part to contain a developing agent; a developing member disposed in the frame and having a portion exposed to an outside of the frame; and a member disposed adjacent to the developing member to generate an air flow to feed a developing agent from the developing member toward the developing agent containing part. The developing device may further include a single power source to control the developing member to develop an image using the developing agent and the member disposed adjacent to the developing member to generate the air flow. The member disposed adjacent to the developing member may rotate at a variable speed according to a status of the developing member. The member disposed adjacent to the developing member may be controlled such that the air flow is variable according to a status of the developing member.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE EMBODIMENTS

Figure 1:
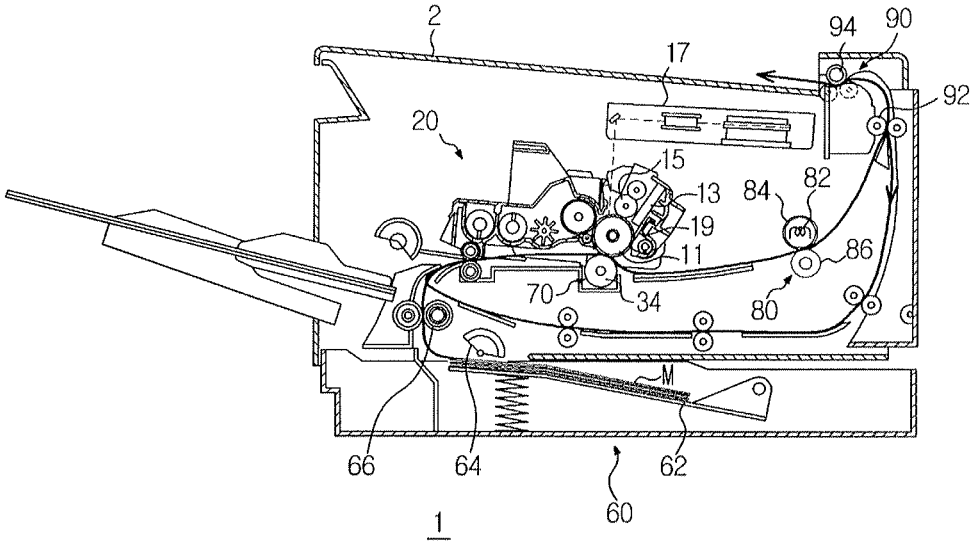
FIG. 1 is a construction view of an image forming apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the drawing figures.

Figure 2:
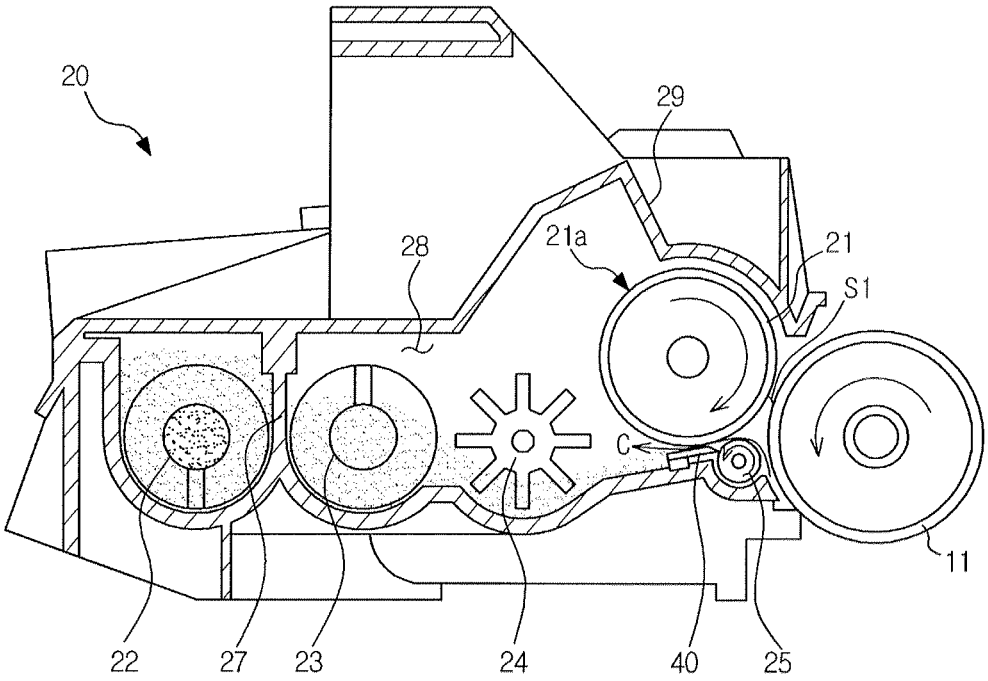
FIG. 2 is a view illustrating an image carrier and a developing device of the image forming apparatus according to the embodiment of the present general inventive concept.

FIG. 1 is a construction view of an image forming apparatus 1 according to an embodiment of the present general inventive concept, and FIG. 2 is a view illustrating an image carrier and a developing device of the image forming apparatus 1 according to the embodiment of the present general inventive concept.

As shown in FIG. 1, the image forming apparatus 1 includes an apparatus body 2, a print media supply device 60, an image carrier 11, a charging device 15, an optical scanning device 17, a developing device 20, a transfer device 70, a fusing device 80, and a paper discharging device 90.

The print media supply device 60 supplies print media M to the developing device 20. The print media supply device 60 includes a tray 62 in which print media M is loaded, a pickup roller 64 to pick up the print media in the tray 62 one by one, and a feed roller 66 to feed the picked-up print media to the developing device 20.

The charging device 15 charges the image carrier 11 with a predetermined potential. The optical scanning device 17 scans light corresponding to image information to the image carrier 11 charged with the predetermined potential to form an electrostatic latent image. The charging device 15 may include a roller disposed to contact the image carrier 11. In another embodiment, the charging device 15 may include a corona discharger.

An organic photoconductive drum may be adopted as the image carrier 11. Also, an amorphous silicon photosensitive body may be adopted as the image carrier 11. In addition, an electrostatic drum (not shown) may be adopted as the image carrier 11. In this case, an electrostatic recording head (not shown) is adopted in place of the optical scanning device 17 to form an electrostatic latent image.

The developing device 20 is detachably mounted in the apparatus body 2. The developing device 20 supplies a developing agent to the image carrier 11 on which the electrostatic latent image is formed to form a visible image. Details of the developing device will be described later.

The transfer device 70 transfers the visible image formed on the image carrier 11 to a print medium. The transfer device 70 may includes a transfer roller 34 to press the print medium supplied from the print media supply device 60 to the image carrier 11.

The fusing device 80 applies heat and pressure to the print media to fix the image to the print medium. The fusing device 80 may include a heating roller 84 having a heating source 82 to transmit heat to the print medium and a pressing roller 86 pressed to the heating roller to apply pressure to the print medium.

The paper discharging device 90, including a first paper discharging roller 92 and a second paper discharging roller 94 disposed sequentially, discharges the print medium having passed through the fusing device 80 out of the image forming apparatus 1.

As shown in FIG. 2, the developing device 20 includes a frame 29, a developing member 21*a*, developing agent feeding members 22, 23 and 24, and a rotary member 25.

A developing agent containing part 28 to contain a developing agent is provided in the frame 29.

The developing member 21*a* is rotatably disposed in the frame 29. The developing member 21*a* supplies the developing agent transmitted from the developing agent containing part 28 to the image carrier 11. The developing member 21*a* may include a magnetic roller 21.

The magnetic roller 21 is located at a position facing the image carrier 11. The magnetic roller 21 and the image carrier 11 are spaced apart from each other by a predetermined distance. The magnetic roller 21 is configured in the form of a sleeve made of anodized aluminum or stainless steel having a volume resistivity of, for example, 10-12 Ω·cm or less or a sleeve having a conductive resin having such volume resistivity coated on the outer circumference thereof.

One or more developing agent feeding members feed the developing agent contained in the developing agent containing part 28 to the developing member 21*a*. The developing agent feeding members may include a first auger 23 and a second auger 22 arranged side by side while a partition wall 27 is disposed between the first auger 23 and the second auger 22 and a paddle 24 disposed between the first auger 23 and the developing member 21*a*. The first auger 23, the second auger 22 and the paddle 24 are rotatably disposed in the developing agent containing part 28.

The developing agent contained in the developing agent containing part 28 is fed by the second auger 22 in an axial direction thereof, and is conveyed to the first auger 23 through a port or opening (not shown) formed in one end of the partition wall 27. The first auger 23 feeds the developing agent in a direction opposite to the direction in which the developing agent is fed by the second auger 22. The paddle 24 supplies the developing agent fed by the first auger 23 to the developing member 21*a*.

Three developing agent feeding members are shown in FIG. 2; however, the number of the developing agent feeding members may be changed.

The rotary member 25 generates air flow to collect the developing agent scattered at a developing region S1 between the image carrier 11 and the developing member 21*a* into the developing agent containing part 28. It is possible that the rotary member 25 generates an air flow to collect the developing agent from the image carrier 11 and the developing member 21*a* to feed the collected developing agent back to an inside of the developing agent containing part 28. The rotary member 25 may be rotatably disposed adjacent to the developing member 21*a*. The rotary member 25 may be disposed in an area in between the image carrier 11 and the developing member 21*a*. The rotary member 25 faces the outer circumference of the image carrier 11 in a non-contact state. The rotary member 25 may be rotated in a direction identical to a rotation direction of the image carrier 11, i.e., in the direction opposite to the rotation direction of the developing member 21*a*, to generate air flow to offset air flow directed downward by the rotation of the image carrier 11 and the developing member 21*a*.

When the rotary member 25 is rotated as described above, air flow is generated between the image carrier 11 and the developing member 21*a* in a direction indicated by an arrow C as shown in FIG. 2. Consequently, the air flow generated by the rotation of the rotary member 25 offsets the air flow generated by the rotation of the image carrier 11 and the developing member 21*a* in the developing region S1. As a result, insufficient charged developing agent may be prevented from being scattered out of the developing device, and scattered developing agent may be collected by the rotary member 25.

Referring to FIG. 2, the developing agent collected by the rotary member 25 is received in the developing agent containing part 28, not in an additional space, with the result that the size of the image forming apparatus may be reduced, and replacement time of consumables may be delayed through the reuse of the collected developing agent.

Figure 3:
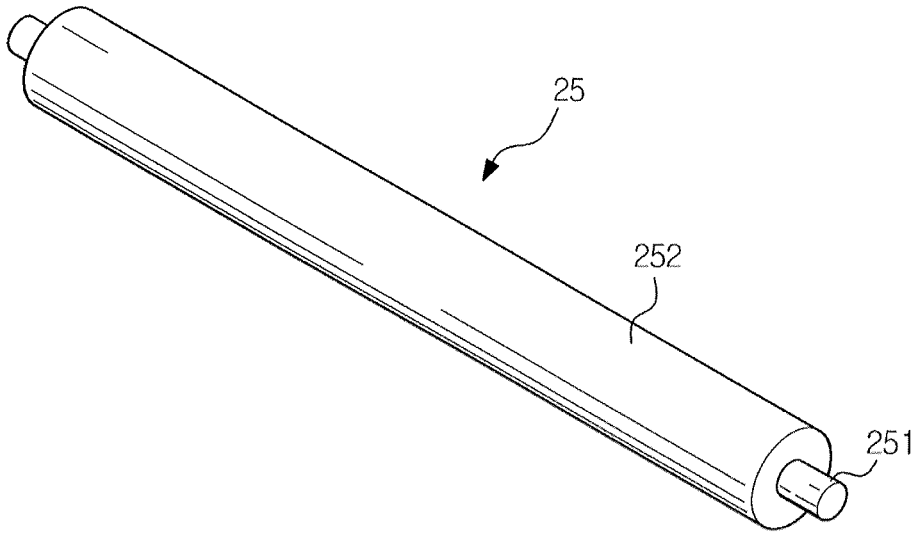
FIG. 3 is a perspective view illustrating a rotary member of a developing device according to an embodiment of the present general inventive concept.
Figure 4:
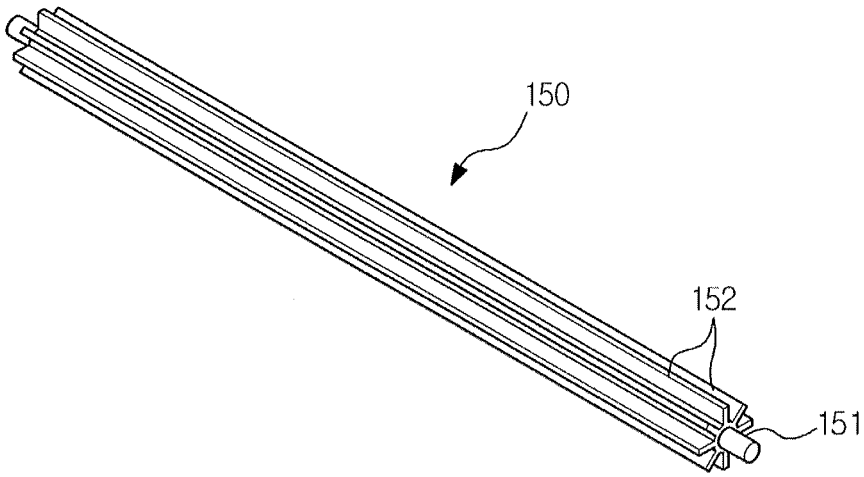
FIG. 4 is a perspective view illustrating another embodiment of the rotary member.

FIG. 3 is a perspective view illustrating a rotary member of a developing device according to an embodiment of the present general inventive concept, and FIG. 4 is a perspective view illustrating another embodiment of the rotary member.

As shown in FIGS. 2 and 3, a rotary member 25 may be configured in the form of a roller including a rotary shaft 251 and a cylindrical body 252 to surround the rotary shaft 251.

Also, as shown in FIG. 4, a rotary member 150 may include a rotary shaft 151 and a plurality of rotary blades 152 protruding from the rotary shaft 151 in the radial direction. Air flow in the direction indicated by the arrow C, i.e., upward air flow, may be facilitated by the rotary blades 152. The amount of air flow generated by the rotation may be controlled by changing the shape and number of the rotary blades and adjusting the rotation speed of the rotary blades.

Also, a collection bias may be applied to the rotary member 25 to collect toner scattered from the magnetic roller 21. A voltage application part (not shown) applies predetermined voltage to the rotary member 25. As a result, predetermined electrostatic force is formed between the rotary member 25 and the image carrier 11 to collect background developing agent in a non-image-bearing region of the image carrier 11 to the rotary member 25. In the related art, the developing agent is supplied to the image carrier, and, in addition, the developing agent in the non-image-bearing region of the image carrier is collected, using a single magnetic roller 21, with the result that development efficiency and background are not simultaneously improved. In this embodiment, the background developing agent of the image carrier 11 is collected using the rotary member 25, not the magnetic roller 21, with the result that development efficiency and background are simultaneously improved.

Also, in this embodiment, a cleaning member 40 may be further provided to clean the rotary member 25. The cleaning member 40, having one end disposed to contact the outer circumference of the rotary member 25, serves to remove the developing agent collected to the rotary member 25 and staying on the surface of the rotary member 25. The cleaning member 40 stays in constant contact with the rotary member 25. Consequently, the cleaning member 40 may be made of a material exhibiting lower hardness than the rotary member 25. For example, the cleaning member 40 may be made of sponge or resin.

Rotation driving force may be applied to the rotary member 25 such that the rotary member 25 is rotated. In the related art, a method of changing rotational motion into rectilinear reciprocation using a cam structure and rotating the scattering prevention member in one direction using a one-way bearing is applied to a coupling to drive the magnetic roller. When the cam structure and the one-way bearing are used, however, a rectilinear reciprocation section may be limited to a narrow range due to spatial restrictions, and drive rotational velocity of the scattering prevention member may be very slow. Therefore, the conventional scattering prevention member collects only the developing agent attached to the scattering prevention member, and does not change air flow therearound such that the developing agent is prevented from being scattered. Also, during the rectilinear reciprocation, impact occurs at opposite end points of the scattering prevention member, and the impact directly affects the magnetic roller, with the result that a jitter and band may be caused in an image.

Also, a drive unit different from a drive unit to drive the magnetic roller 21 may be provided to drive the rotary member 25. In this case, costs may be increased.

In this embodiment, therefore, the developing device 20 has an improved rotary member drive structure.

The rotary member 25 may be configured to be subjected to drive force from one of the developing agent feeding members 22, 23 and 24. In this structure, image defects may be prevented from being caused when load based on the driving of the rotary member 25 is directly transmitted to the developing member 21*a*, and gears may be appropriately disposed among the developing agent feeding members 22, 23 and 24 and the rotary member 25 to freely adjust the rotation speed of the rotary member 25.

Figure 5:
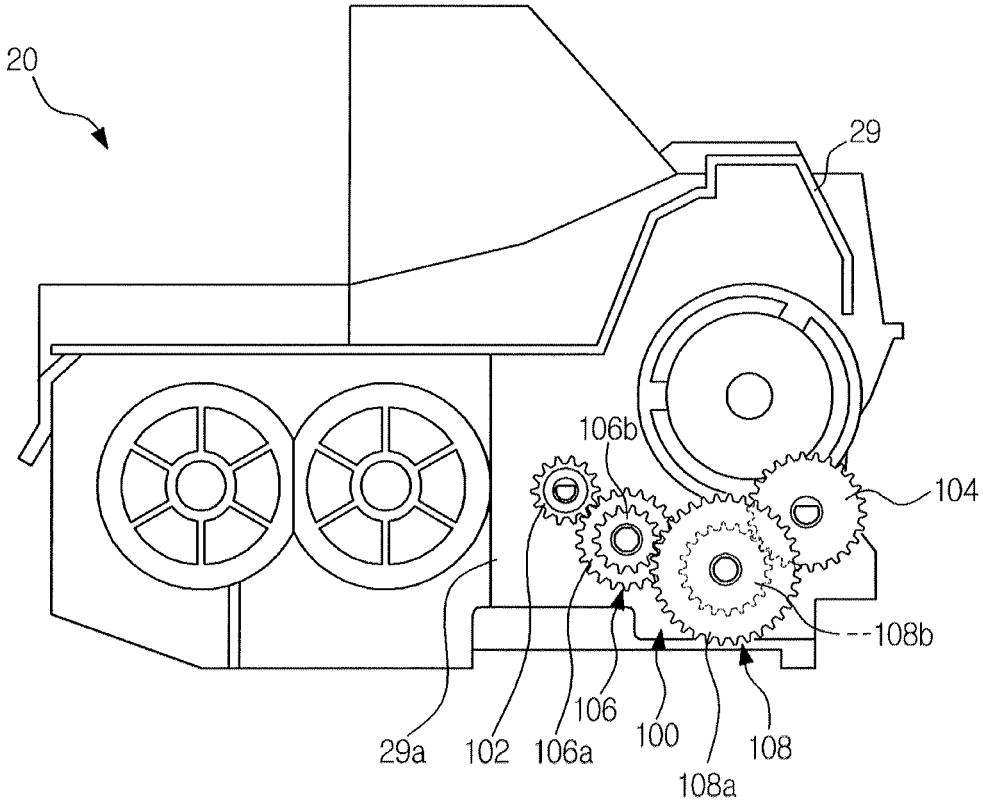
FIG. 5 is a view illustrating an example in which rotational force is transmitted from a paddle to the rotary member in the developing device according to the embodiment of the present general inventive concept.

FIG. 5 is a view illustrating an example in which rotational force is transmitted from the paddle to the rotary member in the developing device according to the embodiment of the present general inventive concept. As shown in FIG. 5, the developing device 20 includes a power transmission unit 100 to transmit rotational force of the paddle 24 to the rotary member 25.

The power transmission unit 100 may include a paddle gear 102 disposed at one side of the paddle 24 so as to be rotated together with the paddle 24, a rotary member gear 104 disposed at one side of the rotary member 25, and idle gears 106 and 108 arranged between the paddle gear 102 and the rotary member gear 104. The gears constituting the power transmission unit 100 may be arranged along one side 29*a* of the frame 29.

The idle gears 106 and 108 may be reduction gears to rotate the rotary member 25 at lower speed than the paddle 24.

The first idle gear 106 may have a large gear part 106*a* and a small gear part 106*b*. The second idle gear 108 may have a large gear part 108*a* and a small gear part 108*b*.

The large gear part 106*a* of the first idle gear 106 is disposed to mesh with the paddle gear 102. The large gear part 108*a* of the second idle gear 108 is disposed to mesh with the small gear part 106*b* of the first idle gear 106. The rotary member gear 104 is disposed to mesh with the small gear part 108*b* of the second idle gear 108.

The number of teeth of the large gear part 106*a* of the first idle gear 106 may be greater than that of the paddle gear 102. The number of teeth of the large gear part 108*a* of the second idle gear 108 may be greater than that of the small gear part 106*b* of the first idle gear 106. Also, the number of teeth of the rotary member gear 104 may be greater than that of the small gear part 108*b* of the second idle gear 108.

Two idle gears are shown in FIG. 5; however, the number of the idle gears may be varied.

Figure 6:
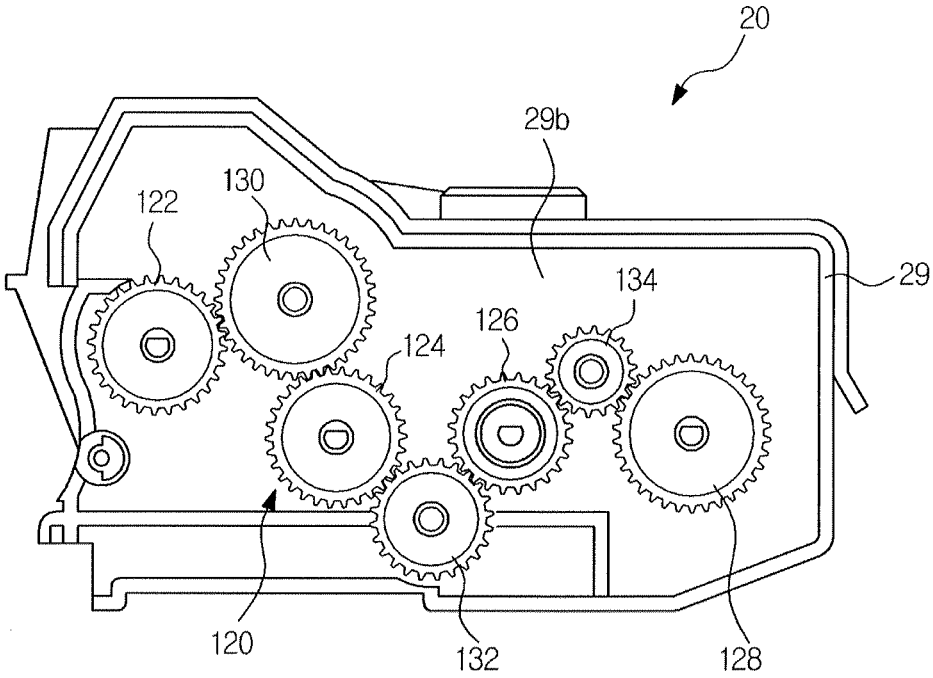
FIG. 6 is a view illustrating a structure to drive developing agent feeding members in the developing device according to the embodiment of the present general inventive concept.

FIG. 6 is a view illustrating a structure to drive the developing agent feeding members in the developing device according to the embodiment of the present general inventive concept.

As shown in FIG. 6, the paddle 24, the first auger 23 and the second auger 22 may be configured to be driven by rotational force from the developing member 21*a*. When the developing device 20 is mounted in the apparatus body 2, the developing member 21*a* is rotated by power from a drive source (not shown) disposed at a side of the apparatus body 2.

The rotational force of the developing member 21*a* is transmitted to the paddle 24, the first auger 23 and the second auger 22 via a gear train 120. The gear train 120 includes a developing member gear 122 disposed at one end of the developing member 21*a* so as to be rotated together with the developing member 21*a*, a paddle drive gear 124 disposed at one end of the developing agent feeding member 22, a first auger drive gear 126 disposed at one end of the developing agent feeding member 23, and a second auger drive gear 128 disposed at one end of the developing agent feeding member 24.

The developing member gear 122 and the paddle drive gear 124 are connected to each other via a first gear 130. The paddle drive gear 124 and the first auger drive gear 126 are connected to each other via a second gear 132. The first auger drive gear 126 and the second auger drive gear 128 are connected to each other via a third gear 134.

The gears constituting the gear train 120 may be arranged along the other side 29*b* of the frame 29, i.e., the side opposite to the side 29*a* of the frame 29.

Figure 7:
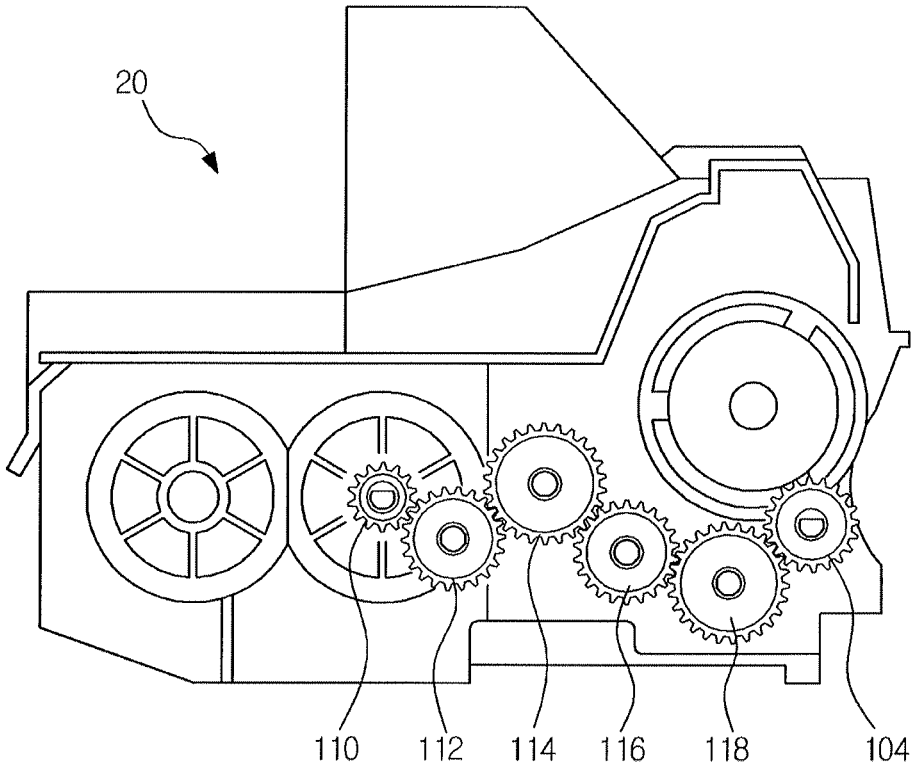
FIG. 7 is a view illustrating an example in which rotational force is transmitted from a first auger to the rotary member in the developing device according to the embodiment of the present general inventive concept.

FIG. 7 is a view illustrating an example in which rotational force is transmitted from the first auger to the rotary member in the developing device according to the embodiment of the present general inventive concept. As shown in FIG. 7, the rotary member 25 may be configured to be driven by rotational force from the first auger 23. In this case, the first auger 23 of the developing device may include a first auger gear 110 disposed opposite to the first auger drive gear 126, and the rotary member gear 104 may be connected to the first auger gear 110 via idle gears 112, 114, 116 and 118.

In addition, the rotary member 25 may be configured to be driven by drive force from another rotary body in the developing device.

When drive rotational velocity of the rotary member 25 is too high, air flow becomes excessively strong, and therefore, reverse air flow is generated in the developing agent containing part 28, with the result that severe scattering occurs. Also, excessive load is applied to the magnetic roller 21 due to high speed, with the result that the image may be troubled.

In this embodiment, the magnetic roller 21 may have a drive rotational velocity of 150 RPM to 800 RPM, and the rotary member 25 may have a drive rotational velocity of 10 RPM to 300 RPM, in consideration of outer diameters thereof and speed ratio therebetween.

According to an experimental example as indicated in Table 1 below, when the rotary member 25 is driven using the paddle gear 102 having a drive rotational velocity of 470 RPM, scattering or image quality is little affected when the drive rotational velocity of the rotary member 25 is 30 RPM to 300 RPM, but scattering or image quality is considerably affected when the drive rotational velocity of the rotary member 25 deviates from the above range. The drive rotational velocity of the rotary member 25 may be 50 RPM to 300 RPM. However, the range of the drive rotational velocity of the rotary member 25 may be varied based on the drive rotational velocity of the magnetic roller 21.

TABLE 1

| Drive rotational velocity of rotary member | Scattering | Occurrence of jitter | Occurrence of band | Result |
|---|---|---|---|---|
| 30 RPM | Δ | ○ | ○ | Satisfactory |
| 50 RPM | ○ | ○ | ○ | Good |
| 100 RPM | ○ | ○ | ○ | Good |
| 150 RPM | ○ | ○ | ○ | Good |
| 200 RPM | Δ | ○ | ○ | Satisfactory |
| 300 RPM | Δ | Δ | ○ | Satisfactory |
| 500 RPM | X | Δ | Δ | Scattering of developing agent due to reverse air flow |
| 700 RPM | X | X | Δ | Scattering of developing agent due to reverse air flow and severe jitter (large load) |
| 1000 RPM | X | X | X | Scattering of developing agent due to reverse air flow and severe jitter and band (large load) |

(○: Good, Δ: Satisfactory, X: Bad)

Figure 8:
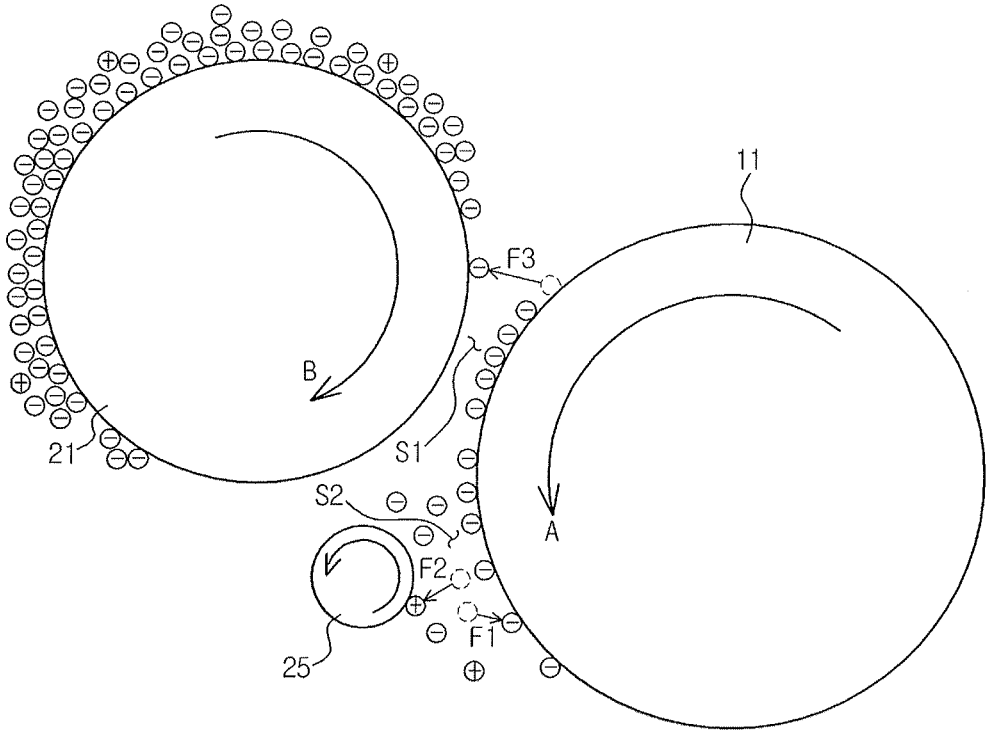
FIG. 8 is a view illustrating an operation to prevent a developing agent from being scattered in the developing device according to the embodiment of the present general inventive concept.

In this embodiment, the drive rotational velocity of the rotary member 25 may be adjusted through the change of the gear train shown in FIGS. 5 and 8, and therefore, the degree of freedom in drive speed of the rotary member 25 may be increased, with the result that the rotary member 25 may be applied in various forms.

Figure 9:
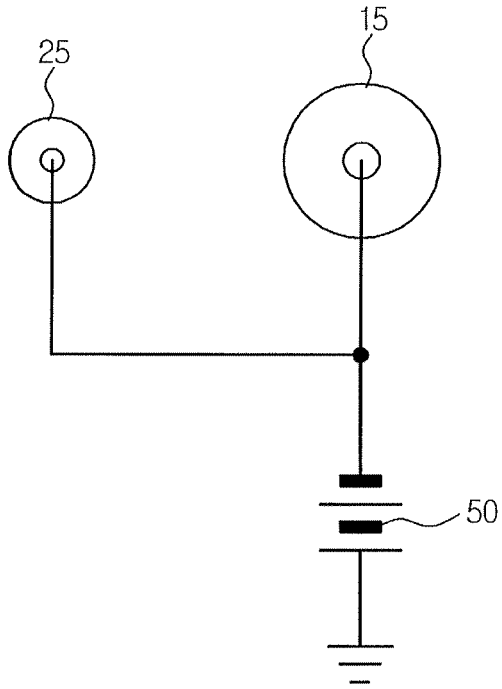
FIG. 9 is a construction view illustrating a power supply to apply voltage to the rotary member in the developing device according to the embodiment of the present general inventive concept.

Hereinafter, the operation of the electrophotographic image forming apparatus will be described in detail with reference to FIGS. 1, 2, 8 and 9. FIG. 8 is a view illustrating an operation to prevent a developing agent from being scattered in the developing device according to the embodiment of the present general inventive concept, and FIG. 9 is a construction view illustrating a power supply to apply voltage to the rotary member in the developing device according to the embodiment of the present general inventive concept.

The image carrier 11 is rotated in the direction indicated by an arrow A.

A charge bias from a power supply 50 (FIG. 9) is applied to the charging device 15. The charging device 15 uniformly charges the outer circumference of the image carrier 11 by contacting the image carrier 11.

The image carrier 11 uniformly charged with regular potential by the charging device 15 is rotated at uniform speed under the control of a controller (not shown) to perform an exposure process by the optical scanning device 17. Such exposure is performed by scanning image data converted into a laser beam from the optical scanning device 17 to the outer circumference of the image carrier 11. At this time, an electrostatic latent image is formed on the outer circumference of the image carrier 11 by the laser beam from the optical scanning device 17. The electrostatic latent image formed on the image carrier 11 reaches the developing region 51 by the rotation of the image carrier 11.

Meanwhile, non-magnetic toner and magnetic carrier are contained in the developing device 20. The carrier is not limited as long as the carrier is formed of magnetic powder. The augers 22 and 23 stir the carrier and toner to frictionally charge the toner. The toner may be charged with negative (−) charge or positive (+) charge. Toner charged to be used in development is referred to as straight-polarity toner, and toner charged with opposite polarity is referred to as reverse-polarity toner. During charging, most of the toner may exhibit straight polarity, and some of the toner may exhibit reverse polarity.

Predetermined supply and developing biases are applied to the paddle 24 and the magnetic roller 21. The supply bias is provided to supply an electric field to move toner from the paddle 24 to the magnetic roller 21 to a space between the paddle 24 and the magnetic roller 21. A direct current bias or a bias having overlapped direct and alternating currents may be adopted. A toner layer is formed on the outer circumference of the magnetic roller 21 by the supply bias.

In this embodiment, the magnetic roller 21 is rotated in the direction indicated by an arrow B. When viewed in the developing section, the rotation direction of the magnetic roller 21 is opposite to the rotation direction (A direction) of the image carrier 11. That is, when the image carrier 11 is rotated in the counterclockwise direction, the magnetic roller 21 is rotated in the clockwise direction, with reference to the drawing. However, this rotational relationship is provided for the convenience of description, and therefore, embodiments of the present general inventive concept are not limited thereto.

When the developing bias is applied to the magnetic roller 21, electrostatic force is generated by potential difference between the image carrier 11 and the magnetic roller 21. When the toner attached to the magnetic roller 21 approaches the image carrier 11 by the rotation of the magnetic roller 21, the toner is separated from the magnetic roller 21 by the electrostatic force and is then attached to an image part of the image carrier 11 constituting an electrostatic latent image. A direct current bias or a bias having overlapped direct and alternating currents may be adopted to develop the electrostatic latent image into a visible toner image. The image part is a portion of the outer circumference of the image carrier 11, which is exposed to a laser beam during exposure with the result that potential difference with respect to potential by the charge bias occurs on the image part, and therefore, the toner is attached to the image part. Meanwhile, a region of the outer circumference of the image carrier 11 where no toner is attached is referred to as a non-image part, which is not exposed to a laser beam during exposure with the result that the potential by the charge bias remains unchanged.

Subsequently, the toner image is transferred to print media by the transfer device 70, and the transferred toner image is fused to the print media by heat and pressure. Reference numerals 19 and 13 indicate a cleaning blade and a static charge remover, respectively. After the transfer of the image to the print media, residual toner and charge on the image carrier 11 are removed by the cleaning blade 19 and the electricity remover 13.

During the above process, the toner is separated from the magnetic roller 21 and flies to the image carrier 11. At this time, some of the toner is scattered by centrifugal force of the magnetic roller 21 rotating at high speed or by air flow generated by the rotation of the image carrier 11 and the magnetic roller 21.

The scattered toner is collected into the developing agent containing part 28 by the rotary member 25. A collection bias is applied to the rotary member 25. The collection bias is applied such that the straight-polarity toner portion of the scattered toner is subjected to electrostatic force F1 acting toward the image carrier 11, and the reverse-polarity toner portion of the scattered toner is subjected to electrostatic force F2 acting toward the rotary member 25. Consequently, the straight-polarity toner portion of the toner, scattered from the magnetic roller 21 and flown to a collection region S2 between the image carrier 11 and the rotary member 25, is attached to the image carrier 11 by an electric field created in the collection region S2. Also, the reverse-polarity toner having flown to the collection region S2 is attached to the rotary member 25 by the electric field created in the collection region S2.

As shown in FIG. 9, the collection bias may be supplied from the power supply 50 to supply a charge bias to the charging device 15, although the collection bias may be supplied from an additional power supply. In this case, the collection bias has the same voltage as the charge bias.

A concrete example of the applied collection bias will be described.

The straight-polarity toner used in development is charged with negative (−) charge. A charge bias of −1400V is applied to the charging device 15, with the result that the image carrier 11 has a potential of about −700V at the outer circumference thereof. A laser beam is irradiated to the outer circumference of the image carrier 11, and therefore, an image part having a negative potential of several tens of volts is formed on the outer circumference of the image carrier 11. As a result, the non-image part of the image carrier 11 is maintained at a potential of −700V, and the image part has a negative potential of several tens of volts, whereby an electrostatic latent image is formed on the image carrier 11. A developing bias is applied to the magnetic roller 21 such that the magnetic roller 21 has a potential of about −400V at the outer circumference thereof.

The magnetic roller 21 has a higher potential than the non-image part of the image carrier 11 but has a lower potential than the image part of the image carrier 11. Consequently, the toner attached to the non-image part of the image carrier 11 is collected by electrostatic force F3 acting toward the magnetic roller 21, and the toner attached to the image part remains.

A collection bias of −1400V is applied to the rotary member 25 from the power supply to supply a charge bias to the charging device 15. Consequently, the potential of the rotary member 25 is lower than those of the image part and non-image part of the image carrier 11. As a result, when the toner scattered from the magnetic roller 21 flies to the collection region S2 between the image carrier 11 and the rotary member 25, the straight-polarity toner is attached to the outer circumference of the image carrier 11 by the electrostatic force F1, and the reverse-polarity toner is attached to the rotary member 25 by the electrostatic force F2.

In this embodiment, therefore, the rotary member 25 attaches the toner to the image part using the scattered toner, thereby auxiliarily contributing to the forming of the electrostatic latent image.

Furthermore, the collected reverse-polarity toner is attached to the rotary member 25 and is collected into the developing agent containing part 29. Consequently, an additional space to store the collected toner is not provided, with the result that the size of the image forming apparatus may be reduced, and replacement time of consumables may be delayed through the reuse of the collected developing agent.

In the electrophotographic image forming apparatus, the magnetic roller 21 and the image carrier 11 are spaced apart from each other by a predetermined distance, i.e., the magnetic roller 21 and the image carrier 11 are disposed in a non-contact state; however, embodiments of the present general inventive concept are not limited thereto. Embodiments of the present general inventive concept may be applied to a contact type developing method.

Furthermore, in the electrophotographic image forming apparatus, the two-component developing agent is used to charge non-magnetic toner using magnetic carrier, and the toner charged on the magnetic roller 21 is scattered to the image carrier to develop the electrostatic latent image; however, embodiments of the present general inventive concept are not limited thereto. For example, embodiments of the present general inventive concept may be applied to a single-component developing method of developing the electrostatic latent image on the image carrier using insulative toner or conductive toner without a carrier. It would be appreciated by those skilled in the art that, when the single-component developing method is used, terms related to the two-component developing method may be changed into ones appropriate to the single-component developing method.

As is apparent from the above description, an effect that the developing member is subjected to by the driving of the rotary member is minimized, thereby preventing deterioration of image quality. In addition, the scattering of the developing agent is effectively prevented by adjusting the drive rotational velocity of the rotary member.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A developing device of an image forming apparatus, comprising:

a developing member rotatably disposed and spaced apart from an image carrier to supply a developing agent to the image carrier;

a developing agent containing part to contain the developing agent;

at least one developing agent feeding member rotatably disposed in the developing agent containing part to feed the developing agent to the developing member;

a rotary member to generate air flow to collect a portion of the developing agent scattered in a developing region between the image carrier and the developing member into the developing agent containing part;

a developing member gear provided at one side of the developing member to be rotated by external drive force;

a rotary member gear provided at one side of the rotary member;

a feeding member gear disposed at one side of the developing agent feeding member to be rotated together with the developing agent feeding member;

at least one idle gear arranged between the feeding member gear and the rotary member gear to transmit rotation force from the developing agent feeding member to the rotary member;

a feeding member drive gear disposed at the other side of the developing agent feeding member; and at least one gear arranged between the developing member gear and the feeding member drive gear to transmit rotation force from the developing member gear to the feeding member drive gear.

2. The developing device according to claim 1, further comprising a cleaning member to clean a surface of the rotary member.

3. The developing device according to claim 1, wherein the rotary member is subjected to a collection bias to collect the portion of the developing agent scattered from the developing member.

4. The developing device according to claim 1, wherein the rotary member has a drive rotational velocity of 50 RPM to 150 RPM.

5. An electrophotographic image forming apparatus comprising:

a developing device comprising:

a developing member rotatably disposed and spaced apart from an image carrier to supply a developing agent to the image carrier;

a developing agent containing part to contain the developing agent;

a rotary member to generate air flow to collect a portion of the developing agent scattered in a developing region between the image carrier and the developing member into the developing agent containing part;

a developing member gear provided at one side of the developing member to be rotated by external drive force; and a rotary member gear provided at one side of the rotary member;

a feeding member gear disposed at one side of the developing agent feeding member to be rotated together with the developing agent feeding member;

at least one idle gear arranged between the feeding member gear and the rotary member gear to transmit rotation force from the developing agent feeding member to the rotary member;

a feeding member drive gear disposed at the other side of the developing agent feeding member; and at least one gear arranged between the developing member gear and the feeding member drive gear to transmit rotation force from the developing member gear to the feeding member drive gear; and a transfer device to transfer a visible image formed on the image carrier to a print medium; and a fusing device to fuse the visible image to the print medium using heat and pressure.

6. A developing device of an image forming apparatus to supply a developing agent to an image carrier to form a visible image on the image carrier, the developing device comprising:

a frame having a developing agent containing part defined therein;

a developing member rotatably disposed in the frame to supply the developing agent to the image carrier;

a developing agent feeding member rotatably disposed in the developing agent containing part to feed the developing agent from the developing agent containing part to the developing member;

a rotary member rotatably disposed and adjacent to the developing member to generate air flow to collect a portion of the developing agent scattered from the developing member into the frame;

a power transmission unit to transmit rotational force from the developing agent feeding member to the rotary member, the power transmission unit being arranged along one side of the frame; and a gear train to transmit rotational force from the developing member to the developing agent feeding member, the gear train being arranged along the other side of the frame.

7. The developing device according to claim 6, wherein the power transmission unit comprises:

a feeding member gear disposed at one side of the developing agent feeding member to be rotated together with the developing agent feeding member;

a rotary member gear disposed at one side of the rotary member; and at least one idle gear disposed between the feeding member gear and the rotary member gear.

8. The developing device according to claim 7, wherein the gear train comprises:

a feeding member drive gear disposed at a side of the developing agent feeding member opposite to the feeding member gear to transmit power to the developing agent feeding member;

a developing member gear disposed at one side of the developing member; and at least one gear arranged to connect the developing member gear and the feeding member drive gear.

9. The developing device according to claim 6, wherein the power transmission unit comprises at least one reduction gear.

10. The developing device according to claim 6, wherein the rotary member is configured to be rotated in a direction opposite to a rotation direction of the developing member.

11. The developing device according to claim 6, wherein the portion of the developing agent collected by the rotary member is forwarded to the developing agent containing part and supplied to the developing member.

12. The developing device according to claim 6, wherein when voltage is applied to the rotary member, the rotary member has a lower potential than a surface of the image carrier.

13. The developing device according to claim 6, further comprising a cleaning member, having one end disposed in contact with a surface of the rotary member, to clean the rotary member.

* * * * *